US010630019B2

(12) United States Patent
Zhang et al.

(10) Patent No.: US 10,630,019 B2
(45) Date of Patent: Apr. 21, 2020

(54) SHELF SYSTEM HAVING ELECTRICAL SUPPLY

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Chengke Zhang, Zhejiang (CN); Zhaoyong Zheng, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/008,813

(22) Filed: Jun. 14, 2018

(65) Prior Publication Data

US 2018/0375250 A1 Dec. 27, 2018

(30) Foreign Application Priority Data

Jun. 21, 2017 (CN) ..... 2017 1 0473316

(51) Int. Cl.

| | |
|---|---|
| ***H01R 13/52*** | (2006.01) |
| ***A47B 96/02*** | (2006.01) |
| ***H01R 4/64*** | (2006.01) |
| *H01R 13/74* | (2006.01) |
| *H01R 13/6584* | (2011.01) |

(52) U.S. Cl.

CPC ..... *H01R 13/5202* (2013.01); *A47B 96/021* (2013.01); *H01R 4/64* (2013.01); *H01R 13/521* (2013.01); *A47B 2220/0091* (2013.01); *H01R 13/5219* (2013.01); *H01R 13/6584* (2013.01); *H01R 13/74* (2013.01); *H01R 13/741* (2013.01); *H01R 13/746* (2013.01); *H01R 13/748* (2013.01)

(58) Field of Classification Search

CPC .. H01R 13/741; H01R 13/748; H01R 13/746; H01R 13/74; H01R 13/5202; H01R 13/6584; H01R 13/5219

USPC ..... 439/544, 545, 550, 552, 562, 548, 556, 439/559, 271, 587, 349, 322

See application file for complete search history.

(56) References Cited

U.S. PATENT DOCUMENTS

| | | | | |
|---|---|---|---|---|
| 6,450,834 B1 * | 9/2002 | Polgar | ..... | H01R 13/74 439/247 |
| 6,869,316 B2 * | 3/2005 | Hinkle | ..... | H01R 24/38 439/578 |
| 2014/0242838 A1 * | 8/2014 | Ikezawa | ..... | H01R 13/521 439/587 |

* cited by examiner

*Primary Examiner* — Abdullah A Riyami
*Assistant Examiner* — Justin M Kratt
(74) *Attorney, Agent, or Firm* — Wang Law Firm, Inc.

(57) ABSTRACT

A shelf system having electrical supply includes at least one backboard and at least one power adjustment mechanism. Each power adjustment mechanism has a socket and a plug. The backboard has a through hole. The socket has an inserting cylinder inserted in the through hole and a clamping portion. The clamping portion has a connecting cylinder, a flange disposed on the connecting cylinder, and a wedge buckle disposed on the connecting cylinder and spaced from the flange. The backboard is sandwiched between the wedge buckle and the flange. The plug is a cylindrical portion inserted in the connecting cylinder. The plug can be arranged on the backboard and the socket can be inserted on the plug. Even if the shelf has been assembled, a user may quickly install the power adjustment mechanism into the shelf.

9 Claims, 4 Drawing Sheets

SHELF SYSTEM HAVING ELECTRICAL SUPPLY

CROSS-REFERENCE TO A RELATED APPLICATION

This application claims priority to a Chinese Patent Application No. CN 201710473316.6, filed on Jun. 22, 2017.

FIELD OF THE TECHNOLOGY

The present invention relates to the shelf equipment, with particular emphasis on a shelf system having electrical supply.

BACKGROUND

The shelf system is widely used, such as in shopping malls, logistics warehouses, factory warehouses and so on, and is used to place goods or display items. In the process of use lighting is necessary in the shelf system, especially in the use of the shelves in the store, the lighting requirements are particularly many, such as saving space, security, easy assembly, aesthetics, and so forth.

In the prior art, the wires of the shelf system having an electrical supply generally first pass through the hollow shelf rail of the shelf system and extend out from the shelf rail. However, when the entire shelf system has been assembled and placed in the mall or supermarket, if users want to adjust the electrical supply, it will be very troublesome as it is difficult to disassemble the entire shelf if needed to rearrange the wires. This has costly results for manpower and wasting time.

SUMMARY OF THE INVENTION

Therefore, it is necessary to provide a shelf system having electrical supply that can accomplish power adjustment without dismantling the entire assembled shelf to meet the above demand.

A shelf system has an electrical supply, comprising: at least one backboard, and at least one power adjustment mechanism; each power adjustment mechanism comprising a socket disposed on the backboard, and a plug inserted in the socket and electrically connected to the socket, the backboard having a through hole for inserting the socket, the socket comprising an inserting cylinder inserted in the through hole and a clamping portion provided at the open end of the inserting cylinder; the clamping portion comprises a connecting cylinder, a flange disposed on the connecting cylinder, and a wedge buckle disposed on the connecting cylinder and spaced from the flange, the backboard being sandwiched between the wedge buckle and the flange; the plug comprising a cylindrical portion inserted in the connecting cylinder.

Further, the socket further comprises an in-line type DC plug provided in the inserting cylinder, and the plug further comprises an in-line type DC socket provided on the cylindrical portion.

Further, an inner diameter of the connecting cylinder corresponds to an outer diameter of the inserting cylinder, and an outer diameter of the connecting cylinder corresponds to a diameter of the through hole.

Further, in a cross section along the axial direction of the inserting cylinder, the radius of the hypotenuse of the wedge buckle gradually increases toward the direction of the flange.

Further, a sealing ring is further disposed on the side wall of the cylindrical portion along the axial direction of the inserting cylinder, and the sealing ring is sandwiched between the cylindrical portion and the connecting cylinder.

Further, a groove is formed on the side wall of the cylindrical portion along the axial direction of the inserting cylinder, and the groove is configured to set the sealing ring.

Further, the entrance diameter of the inner wall of the connecting cylinder is equal to the outer diameter of the sealing ring, and the entrance diameter of the inner wall located close to the inserting cylinder is smaller than the maximum diameter of the sealing ring.

Further, the socket further comprises a buckle plug connected to the flange, and the buckle plug is disposed in the connector cylinder.

Further, the plug further comprises a base for positioning the cylindrical portion, and a pull ring disposed on the base, and the diameter of the base corresponds to the maximum diameter of the flange.

Further, each power adjustment mechanism further comprises a receiving tray, the receiving tray is embedded in the backboard, the socket is received in the receiving tray; and the plug further comprises a base for positioning the cylindrical portion, the thickness of the base along the axial direction of the inserting cylinder corresponds to the depth of the receiving tray.

Compared with the prior art, the shelf system having electrical supply provided by the present invention has the plug and the socket positioned so that the plug can be arranged on the backboard and the socket can be inserted on the plug. When assembling the shelf, whether the shelf system needs to be installed or not, the shelf system is not taken into account. Even if the shelf has been installed, it is also possible to quickly install the power adjustment mechanism into the shelf, thereby avoiding the waste of manpower and time.

DETAILED DESCRIPTION OF THE DRAWINGS

The drawings described herein are intended to promote a further understanding of the present invention, as follows.

DESCRIPTION OF THE PREFERRED EMBODIMENTS

The present application is illustrated by way of the following detailed description based on the accompanying drawings. It should be noted that illustrations to the embodiment of this application are not intended to limit the invention.

Figure 1:
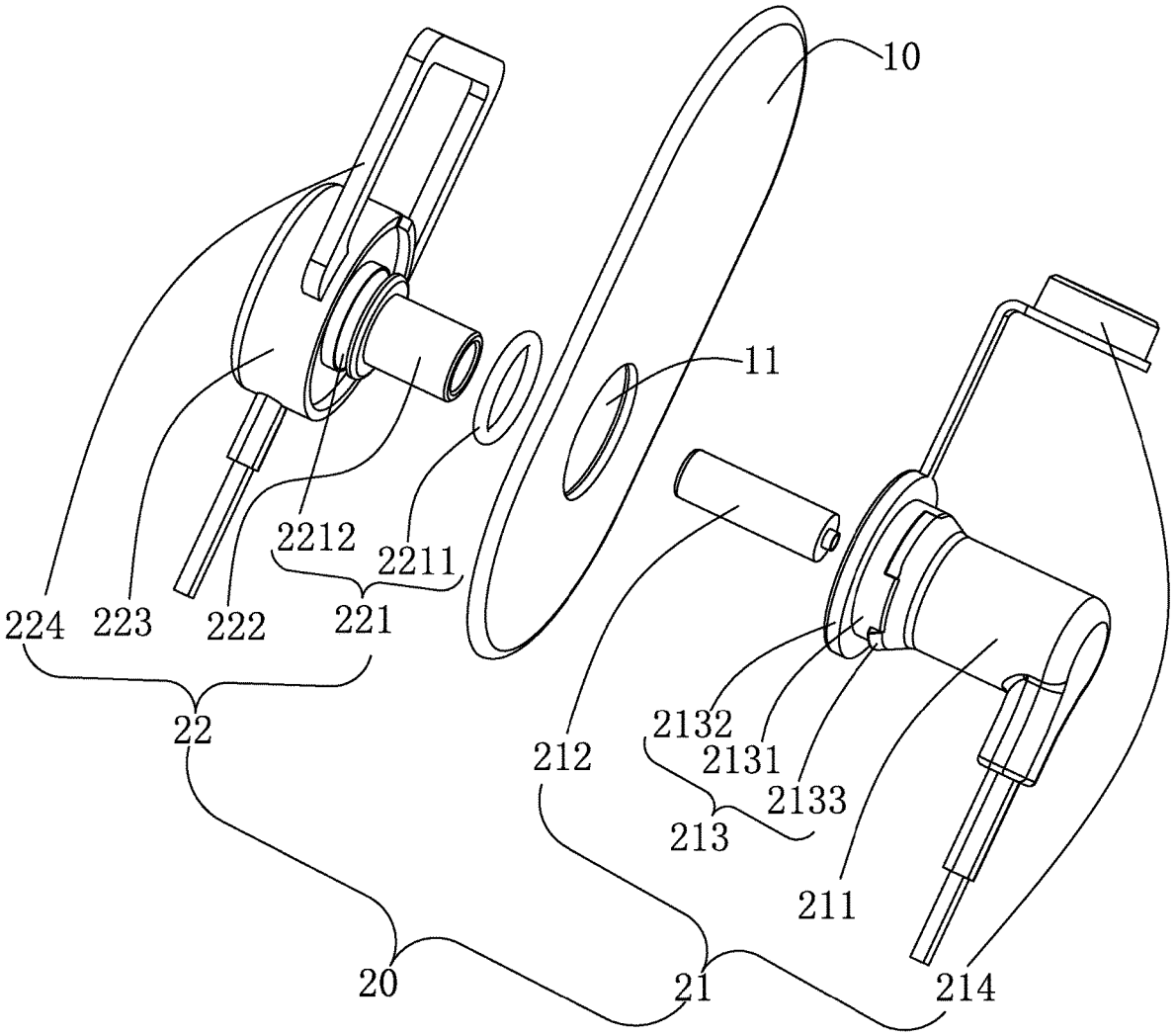
FIG. 1 is an exploded structure diagram of a shelf system having electrical supply according to a first embodiment of the present invention.
Figure 2:
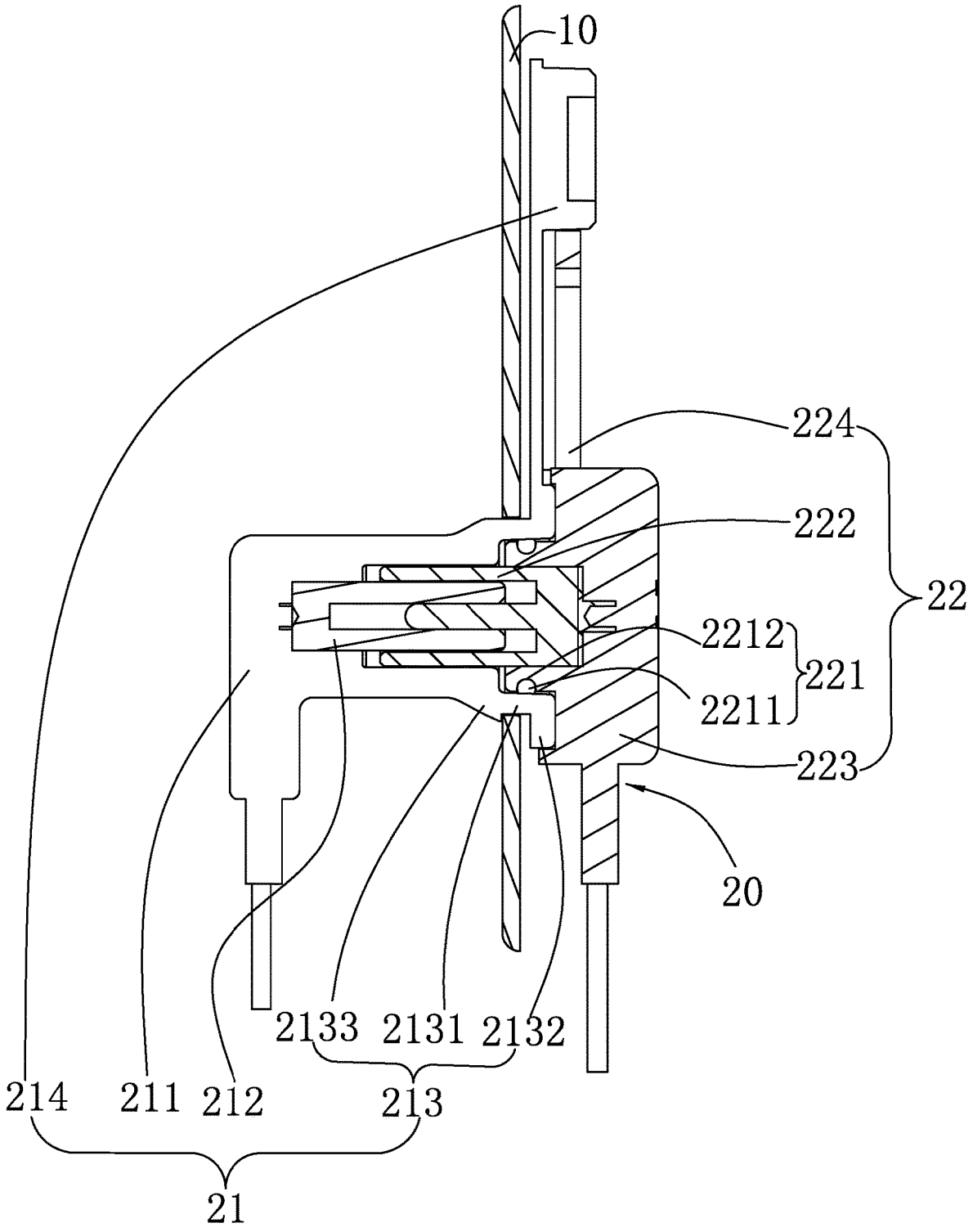
FIG. 2 is a cross-sectional structure diagram of the shelf system having the electrical supply of FIG. 1.

Please refer to FIG. 1 and FIG. 2, which are structure diagrams of a shelf system 100 having electrical supply according to the present invention. The shelf system 100 having electrical supply comprises at least one backboard 10, and at least one power adjustment mechanism 20 disposed on the backboard. It is envisioned that the shelf system 100 further comprises other basic components such as uprights, booms, shelves and the like, as well as some electrical wires for connecting electric supply to the power adjustment mechanism 20 and for connecting the power adjustment mechanism 20 to the lamps. These are known to those skilled in the art, and details are not described herein again.

The backboard 10 is usually a flat plate made of a metal material such as steel, which is inserted on the shelf rail for isolating different shelf space. The structure of the backboard 10 is the same as the structure of the backboard in the existing supermarkets and shopping centers, and details are not described herein again. The backboard 10 comprises at least one through hole 11. The through hole 11 is used to set the power adjustment mechanism 20. It can be understood that the through hole 11 can be opened according to present needs, such as the requirements of the location where the backboard 10 is disposed. The through hole 11 can be opened after the backboard 10 is installed in the shelf, or can be opened before the backboard 10 is installed.

Each power adjustment mechanism 20 has the same structure and function. Only one power adjustment mechanism 20 is taken as an example to describe its structure and function. The power adjustment mechanism 20 comprises a socket 21 disposed on the backboard 10 and a plug 22 inserted into the socket 21 and electrically connected to the socket 21.

The socket 21 comprises an inserting cylinder 211 inserted in the through hole 11, an in-line type DC plug 212 provided in the inserting cylinder 211, and a clamping portion 213 provided at the open end of the inserting cylinder 211. The inserting cylinder 211 is used to hold the in-line type DC plug 212, which may be formed by injection molding. The in-line type DC plug 212 is a standard component and is integrally injection molded with the inserting cylinder 211. The in-line type DC plug 212 will not be described herein further because it is a standard component. The in-line type DC plug 212 is spaced apart from the inner side wall of the inserting cylinder 211 for inserting the plug 22. The clamping portion 213 comprises a connecting cylinder 2131 extending from an open end of the inserting cylinder 211 to the axial direction of the inserting cylinder 211, a flange 2132 disposed on the inserting cylinder 2131, and a wedge buckle 2133 disposed on the connecting cylinder 2131 and spaced from the flange 2132. The connecting cylinder 2131 may also be integrally injection-molded with the inserting cylinder 211, and an inner diameter of the connecting cylinder 2131 corresponds to an outer diameter of the inserting cylinder 211, and an outer diameter of the connecting cylinder 2131 corresponds to a diameter of the through hole 11 so as to form a step between the connecting cylinder 2131 and the inserting cylinder 211. When the connecting cylinder 2131 is inserted into the through hole 11, the flange 2132 and the wedge buckle 2133 are used for clamping the backboard 10, and therefore the maximum diameter of the flange 2132 and the wedge buckle 2133 should be larger than the diameter of the through hole 11. In order to insert the connecting cylinder 2131 in the through hole 11, in a cross section along the axial direction of the inserting cylinder, the radius of the hypotenuse of the wedge buckle 2133 gradually increases toward to direction of the flange 2132. When the inserting cylinder 211 is inserted into the through hole 11, the wedge buckle 2133 and the through hole 11 will undergo deformation in their respective yield limits by the hypotenuse of the wedge buckle 2133, the wedge buckle 2133 can pass through the through hole 11 so that the backboard 10 is sandwiched between the wedge buckle 2133 and the flange 2132. In addition, in order to make it easier to insert the wedge buckle 2133 into the through hole 11, the socket 21 can be made of a soft material, such as rubber. The socket 21 further comprises a buckle plug 214 connected to the flange 2132, and the buckle plug 214 is stuffed in the connector cylinder 2131 for the aesthetic appearance. That is, when the plug 22 is not inserted into the socket 21, the buckle plug 214 is inserted into the connecting cylinder 2131 so that the entire backboard is flat. A second aim is to prevent dust or water vapor from entering the inserting cylinder 211 to affect the reliability of the in-line type DC plug 212.

The plug 22 comprises a cylindrical portion 221 inserted in the connecting cylinder 2131, an in-line type DC socket 222 provided in the inserting cylinder 211, a base 223 for positioning the cylindrical portion 221, and a pull ring 224 disposed on the base 223. The cylindrical portion 221 is inserted in the connecting cylinder 211. In order to achieve the purpose of waterproofing, a sealing ring 2211 is further disposed on the cylindrical portion 221, and the sealing ring 2211 is sandwiched between the cylindrical portion 221 and the connecting cylinder 2131. In order to fix the sealing ring 2211, a groove 2212 is formed on the side wall of the cylindrical portion 221 along the axial direction of the inserting cylinder 211, and the groove 2212 is configured to set the sealing ring 2211. In order to increase the tightness, the entrance diameter of the inner wall of the connecting cylinder 2131 is equal to the outer diameter of the sealing ring 2211, and the entrance diameter of the inner wall located close to the inserting cylinder 2131 is smaller than the maximum diameter of the sealing ring 2211. The cylindrical portion 221 facilitates the insertion of the connecting cylinder 2131 and improves the waterproofing level. The in-line type DC socket 222 is also a standard component and the in-line type DC socket 222 and the plug-in type DC plug 212 are a set of mating components, and they should be well known to those skilled in the art and will not be described in detail herein. The in-line type DC socket 222 is disposed coaxially with the cylindrical portion 221. The base 223 is disposed on the cylindrical portion 221 opposite to the in-line type DC socket 222 and the function is to protect the connection wires of the in-line type DC socket 222 while facilitating installation. The diameter of the base 223 corresponds to the diameter of the flange 2132, so as to facilitate the appearance. The pull ring 224 is disposed on the base 223 for pulling the socket 21 from the plug 22 when the socket 21 is inserted into the plug 22 for easy disassembly.

Figure 3:
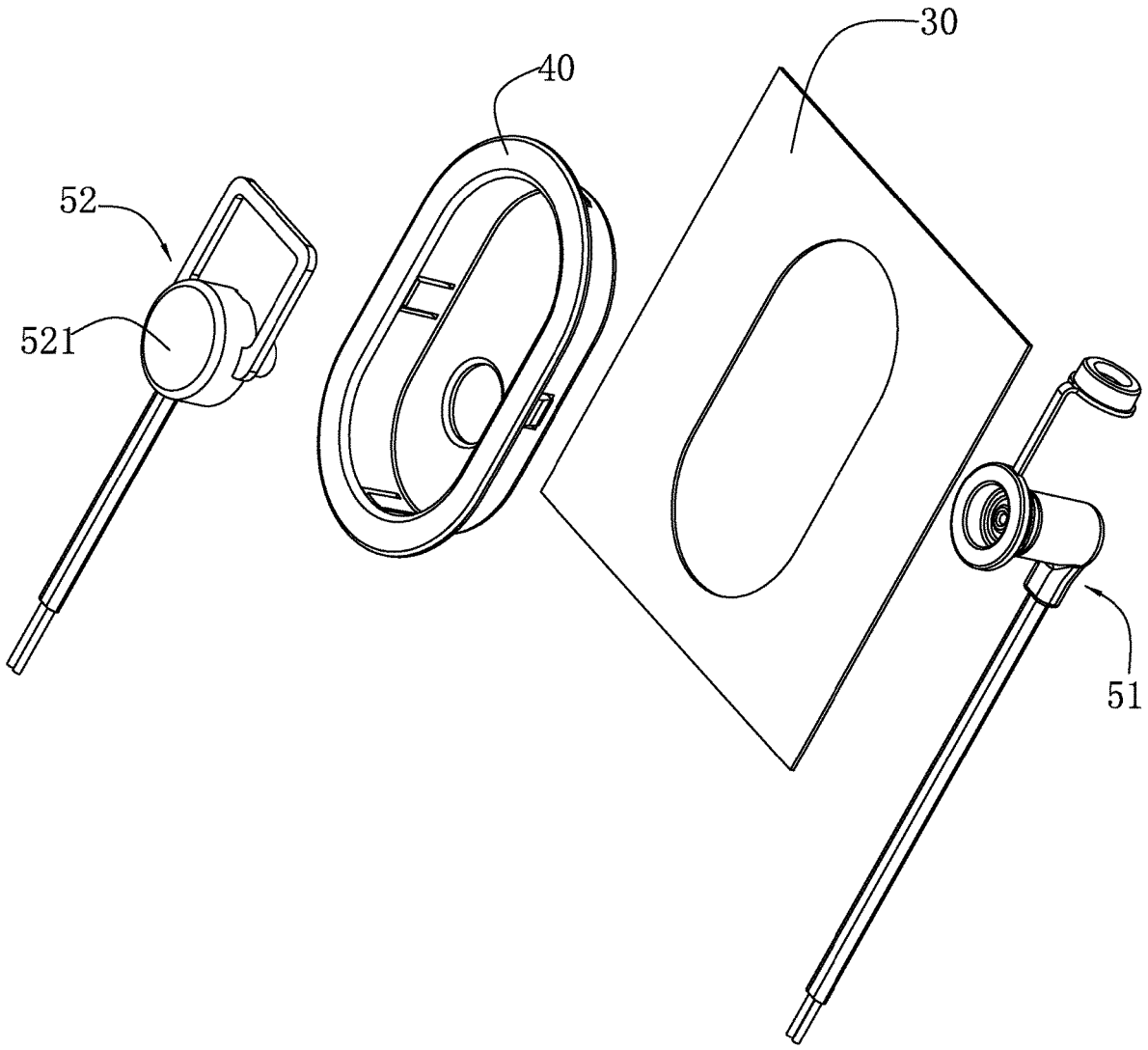
FIG. 3 is an exploded structure diagram of a shelf system having an electrical supply according to a second embodiment of the present invention.
Figure 4:
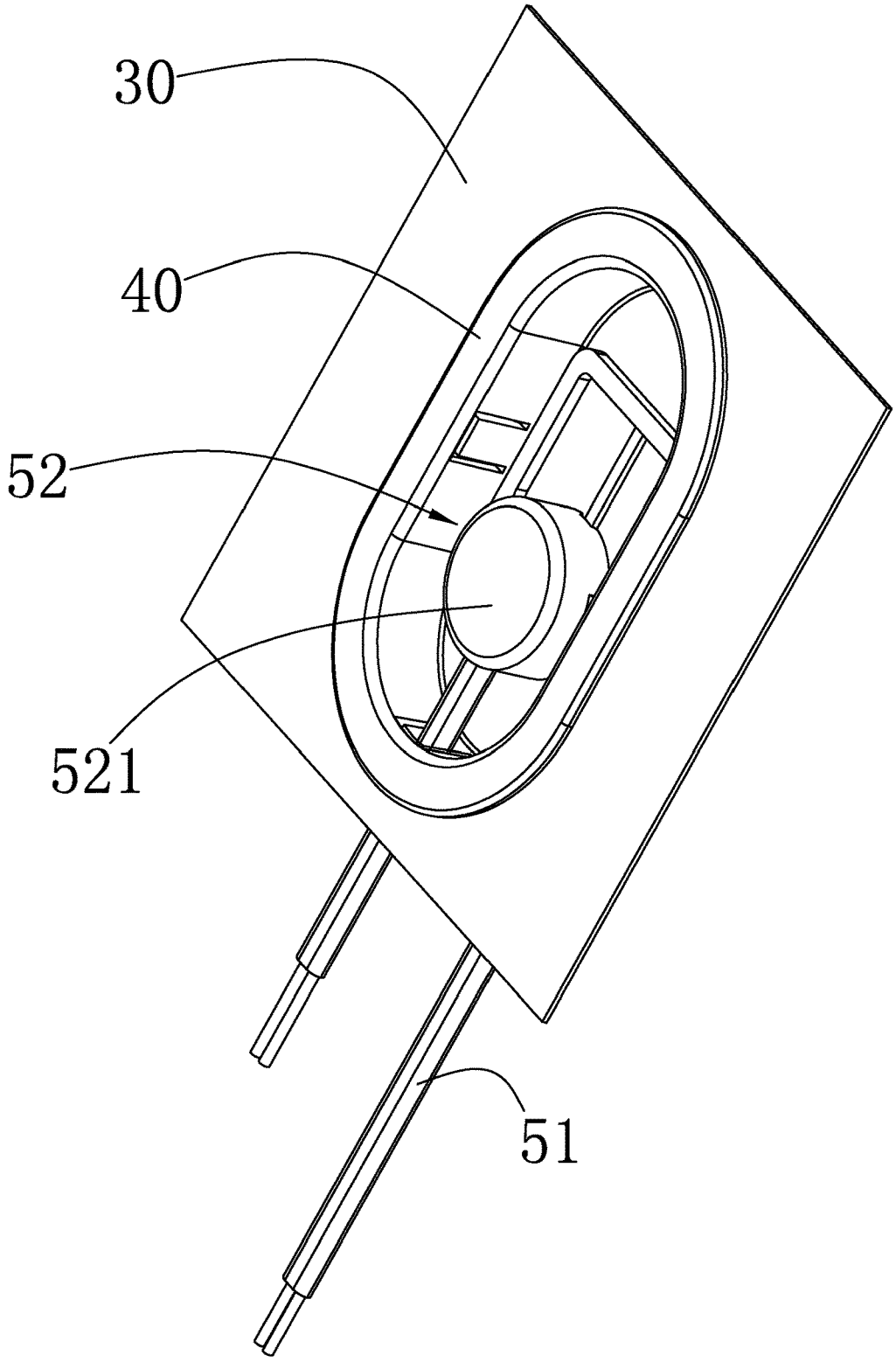
FIG. 4 is an assembly structure diagram of the shelf system having the electrical supply of FIG. 3

Please refer to FIG. 3 and FIG. 4, which are an exploded structure diagrams of a shelf system having electrical supply according to a second embodiment of the present invention. The shelf system further comprises at least one backboard 30, a receiving tray 40 embedded in the backboard 30, and at least one power adjustment mechanism 50 disposed on the receiving tray 40. The difference between the second embodiment and the first embodiment lies in that the second embodiment adds the receiving tray 40, the power adjustment mechanism 50 is completely the same as the power adjustment mechanism 20 of the first embodiment, ie, comprises the plug 51 and socket 52.

In the first embodiment, the flange 2132 and the base 223 protrude from the backboard 10, which affects the appearance of the shelf. In order to make the backboard 30 flat and beautiful, the receiving tray 40 is provided in the second embodiment. The receiving tray 40 is embedded in the backboard 30, and the plug 51 is received in the receiving tray 40. The receiving method is the same as in the first embodiment. The socket 52 is inserted into the plug 51 and electrically connected to the plug 51. The socket 52 comprises a base 521. The depth of the base 521 corresponds to that of the receiving tray 40, so that the side of the backboard 30 facing the customer can be flat, which is aesthetically pleasing.

Compared with the prior art, the shelf system 100 having electrical supply provided by the invention has the plug 22 and the socket 21 so that the plug 22 can be arranged on the backboard 10 and the socket 21 can be inserted on the plug 22. When assembling the shelf, the shelf system is not taking into account whether the shelf system needs to be installed or not. Even if the shelf has been installed, it is also possible to quickly install the power adjustment mechanism 20 into the shelf, thereby avoiding waste of manpower and time.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

The invention claimed is:

1. A shelf system having electrical supply, comprising:

at least one backboard (10) with a through hole, and at least one power delivery mechanism (20), the at least one power delivery mechanism comprises a socket (21) mounted on the backboard, and a plug (22) inserted through the through hole into the socket and electrically connected to the socket, the socket comprises an inserting cylinder (211) inserted in the through hole and a clamping portion (213) provided at an open end of the inserting cylinder;

the clamping portion comprises a connecting cylinder (2131) with an inner wall, a flange (2132) disposed on the connecting cylinder, and a wedge buckle (2133) disposed on the connecting cylinder and spaced from the flange, the backboard being sandwiched between the wedge buckle and the flange, and the plug comprises a cylindrical portion (221) inserted in the connecting cylinder, wherein an inner diameter of the connecting cylinder corresponds to an outer diameter of the inserting cylinder, and an outer diameter of the connecting cylinder corresponds to a diameter of the through hole.

2. The shelf system as claimed in claim 1, wherein the socket further comprises an in-line type DC plug provided in the inserting cylinder, and the plug further comprises an in-line type DC socket provided on the cylindrical portion.

3. The shelf system as claimed in claim 1, wherein in a cross section along the axial direction of the inserting cylinder, the radius of the hypotenuse of the wedge buckle gradually increases toward to a direction of the flange.

4. The shelf system as claimed in claim 1, wherein a sealing ring is further disposed on the side wall of the cylindrical portion along the axial direction of the inserting cylinder, and the sealing ring is sandwiched between the cylindrical portion and the connecting cylinder.

5. The shelf system as claimed in claim 4, wherein a groove is formed on the side wall of the cylindrical portion along the axial direction of the inserting cylinder, and the groove is configured to set the sealing ring.

6. The shelf system as claimed in claim 4, wherein an entrance diameter of the inner wall of the connecting cylinder is equal to an outer diameter of the sealing ring, and the entrance diameter of the inner wall located close to the inserting cylinder is smaller than a maximum diameter of the sealing ring.

7. The shelf system as claimed in claim 1, wherein the socket further comprises a buckle plug connected to the flange, and the buckle plug is stuffed in the connecting cylinder when the plug is not inserted in the connecting cylinder.

8. The shelf system as claimed in claim 1, wherein the plug further comprises a base for positioning the cylindrical portion, and a pull ring disposed on the base, and the diameter of the base corresponds to the maximum diameter of the flange.

9. The shelf system as claimed in claim 1, wherein each power delivery mechanism further comprises a receiving tray, the receiving tray is embedded in the backboard, the socket is received in the receiving tray; and the plug further comprises a base for positioning the cylindrical portion, the thickness of the base along the axial direction of the inserting cylinder corresponds to the depth of the receiving tray.

* * * * *